US010458629B2

(12) United States Patent
Zanotto et al.

(10) Patent No.: US 10,458,629 B2
(45) Date of Patent: Oct. 29, 2019

(54) LIGHTING MODULE AND LIGHTING SYSTEM

(71) Applicant: OSRAM GmbH, Munich (DE)

(72) Inventors: Alberto Zanotto, Padua (IT); Simon Bobbo, Mirano (IT); Lorenzo Baldo, Giavera del Montello (IT); Roberto Didone', Rosà (IT); Valerio Michielan, Mogliano Veneto (IT); Matteo Caldon, Fossò (IT)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 15/921,796

(22) Filed: Mar. 15, 2018

(65) Prior Publication Data

US 2018/0283661 A1 Oct. 4, 2018

(30) Foreign Application Priority Data

Mar. 29, 2017 (IT) ..... 102017000034501

(51) Int. Cl.

| | |
|---|---|
| ***F21V 21/08*** | (2006.01) |
| ***F21V 17/04*** | (2006.01) |
| ***F21V 19/00*** | (2006.01) |
| ***F21V 19/04*** | (2006.01) |
| ***F21V 21/35*** | (2006.01) |
| ***H01R 13/24*** | (2006.01) |

(Continued)

(52) U.S. Cl.

CPC ..... *F21V 21/08* (2013.01); *F21S 4/20* (2016.01); *F21S 4/24* (2016.01); *F21V 17/04* (2013.01); *F21V 19/004* (2013.01); *F21V 19/0005* (2013.01); *F21V 19/04* (2013.01); *F21V 21/35* (2013.01); *H01R 13/2457* (2013.01); *H01R 25/142* (2013.01); *F21Y 2103/30* (2016.08); *F21Y 2115/10* (2016.08)

(58) Field of Classification Search

CPC ..... F21S 4/24

See application file for complete search history.

(56) References Cited

U.S. PATENT DOCUMENTS

| | | | |
|---|---|---|---|
| 2009/0096341 | A1 | 4/2009 | Dobler et al. |
| 2009/0244909 | A1 | 10/2009 | Chen |

(Continued)

FOREIGN PATENT DOCUMENTS

| | | | |
|---|---|---|---|
| DE | 20 2008 011 979 | U1 | 12/2008 |
| DE | 10 2011 076 128 | A1 | 11/2012 |
| EP | 2077416 | A2 | 7/2009 |

OTHER PUBLICATIONS

Italian Search Report based on application No. 102017000034501 (6 pages) dated Oct. 31, 2017 (for reference purpose only).

(Continued)

*Primary Examiner* — Joseph L Williams
*Assistant Examiner* — Jacob R Stern
(74) *Attorney, Agent, or Firm* — Viering Jentschura & Partner MBB

(57) ABSTRACT

A lighting module includes a base, at least one electrically powered light radiation source carried by said base, a plurality of lamina electrical contacts connected to said light radiation source, and having respective proximal ends fixed to said base and respective distal ends elastically pressed against one face of said base, wherein the distal ends of said lamina electrical contacts have respective mutually offset contact areas.

10 Claims, 6 Drawing Sheets

(51) Int. Cl.

| | |
|---|---|
| ***F21S 4/20*** | (2016.01) |
| ***F21S 4/24*** | (2016.01) |
| ***H01R 25/14*** | (2006.01) |
| *F21Y 115/10* | (2016.01) |
| *F21Y 103/30* | (2016.01) |

(56) References Cited

U.S. PATENT DOCUMENTS

| | | | | |
|---|---|---|---|---|
| 2010/0210133 | A1* | 8/2010 | Mochizuki ..... | H01R 4/183<br>439/421 |
| 2010/0323564 | A1 | 12/2010 | Clark et al. | |
| 2014/0268835 | A1 | 9/2014 | Rudisill et al. | |

OTHER PUBLICATIONS

European Office Action based on Application No. 18 161 830.7, 4 pages, dated Jun. 28, 2019 (for reference purpose only).

* cited by examiner

LIGHTING MODULE AND LIGHTING SYSTEM

RELATED APPLICATIONS

This application claims priority to Italian Patent Application 102017000034501, filed Mar. 29, 2017, the entirety of which is incorporated herein by reference.

TECHNICAL FIELD

Various embodiments relate to lighting modules and systems.

One or more embodiments may refer to lighting modules employing electrically powered solid-state light radiation sources, e.g. LED sources.

One or more embodiments may concern a lighting system including a conductive support having a plurality of conductive tracks, and at least one lighting module connected to the conductive support.

BACKGROUND

In the sector of lighting technology, the use is widespread of lighting systems including a plurality of lighting modules, which are mutually connected by an elongate electrical connection element.

The connection among the various lighting modules may be achieved in different ways. A first solution for achieving electrical connection among the lighting modules may envisage soldering electrical cables directly on the lighting modules. Another approach for achieving the electrical connection of the lighting modules may involve the use of electrical connectors made of two parts, with a first connector part which may be connected to the conductive support and a second connector part which may be connected to the lighting module.

Both solutions comprise pros and cons.

The soldering process may be rather flexible, because it may enable using cables having different lengths and changing the distance or pitch between the lighting modules. However, the soldering process may be slow and may cause difficulties to the end user.

The use of connectors may be simpler for the end user, but may be more expensive.

In some applications, the end user may need to change the position of one or more lighting modules on a chain, or to change the pitch between lighting modules. Generally speaking, traditional solutions do not meet these needs in a simple way.

SUMMARY

One or more embodiments aim at helping overcome the previously outlined drawbacks.

According to one or more embodiments, said object may be achieved thanks to a lighting module and a lighting system having the features set forth in the claims that follow.

The claims are an integral part of the technical teaching provided herein with reference to the embodiments.

One or more embodiments may concern a lighting module including:

- a base,
- at least one electrically powered light radiation source, carried by said base,
- a plurality of lamina electrical contacts (32', 32") connected to said light radiation source, and having respective proximal ends fixed to said base and respective distal ends elastically pressed against one face of said base, wherein the distal ends of said lamina electrical contacts have respective mutually offset contact areas.

One or more embodiments may concern a lighting system comprising:

- a conductive support, including a tape of insulating material, having a first face and a second face and a plurality of conductive tracks applied on said first face, extending along a longitudinal direction and spaced apart along a transverse direction, and
- at least one lighting module connected to said conductive support, wherein a face of the base of the lighting module rests against said second face of said tape, and wherein said contact areas of said lamina electrical contacts are elastically pressed against respective conductive tracks of said conductive support.

One or more embodiments may offer one or more advantages, such as:

- easy mutual connection of the lighting modules,
- possibility of implementing lighting modules of any shape,
- possibility of combining different lighting modules having the same connection system,
- possibility of having different pitches between the lighting modules in one and the same application,
- possibility of removing individual lighting modules easily and without using tools,
- possibility of changing the position of individual lighting modules in the final application, by sliding the application module along the conductive support (which is not possible with current solutions, especially in the solutions envisaging piercing connectors),
- possibility of implementing crossings and branches without the need of additional components.

BRIEF DESCRIPTION OF THE DRAWINGS

In the drawings, like reference characters generally refer to the same parts throughout the different views. One or more embodiments will now be described, by way of non-limiting example only, with reference to the annexed drawings, wherein.

It will be appreciated that, for clarity and simplicity of illustration, the various Figures may not be drawn to the same scale.

DETAILED DESCRIPTION

In the following description, various specific details are given to provide a thorough understanding of various exemplary embodiments. The embodiments may be practiced without one or several specific details, or with other methods, components, materials, etc. In other instances, well-known structures, materials or operations are not shown or described in detail in order to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring exactly to the same embodiment. Furthermore, particular features, structures, or characteristics may be combined in any suitable manner in one or more embodiments.

The headings provided herein are for convenience only, and therefore do not interpret the extent of protection or scope of the embodiments.

Figure 1:
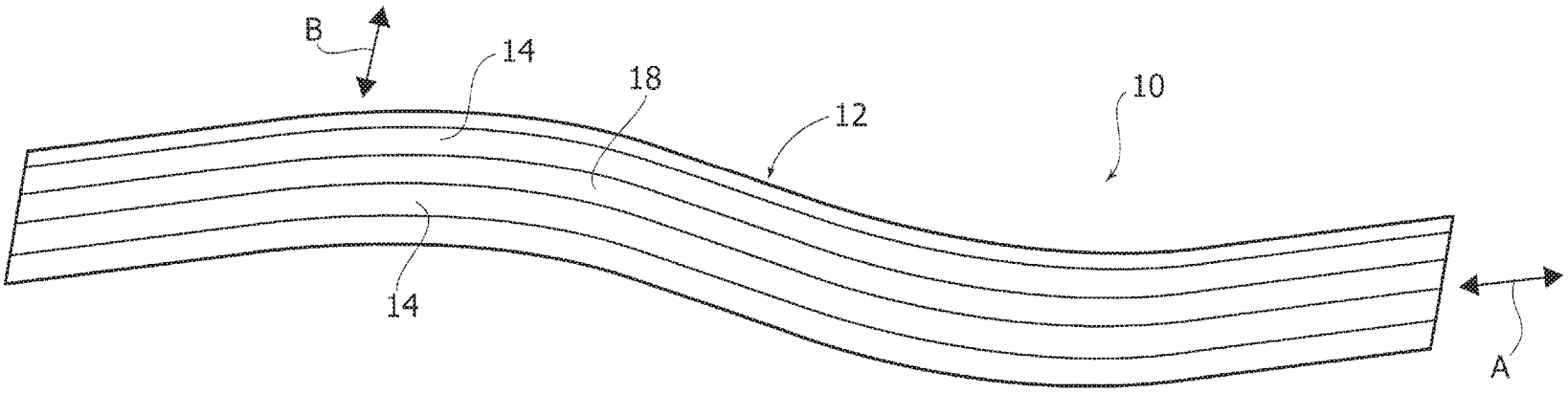
FIGS. 1 and 2 are perspective views, from different angles, of a conductive support for a lighting system.
Figure 2:
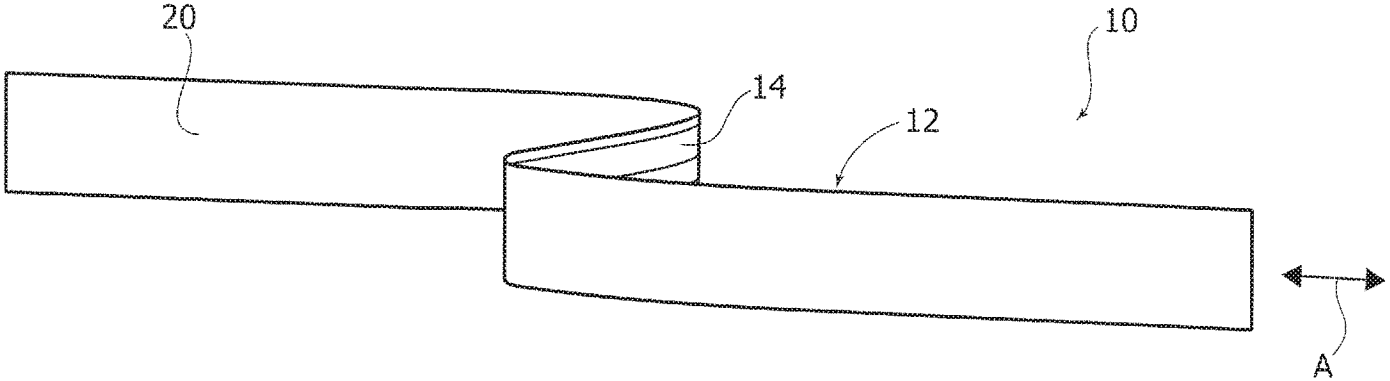

In FIGS. 1 and 2, reference 10 denotes a conductive support for lighting devices. The conductive support 10 may include a tape 12 elongated in a longitudinal direction A. The tape 12 may have a first face 18 and a second face 20 opposite each other. The tape 12 may include an insulating flexible material, e.g. PET, PI, PEN, etc.

The conductive support 10 may include two or more conductive tracks 14, applied on the first face 18 of tape 12. The conductive tracks 14 may extend continuously along the longitudinal direction A. The conductive tracks 14 may be electrically insulated from each other in a transverse direction B, orthogonal to the longitudinal direction A.

The conductive tracks 14 may be made of copper, laminated onto face 18 of tape 12. A finishing treatment may be applied onto the conductive tracks 14 in order to prevent oxidation and ensure an optimum electrical connection with the lighting modules.

Figure 3:
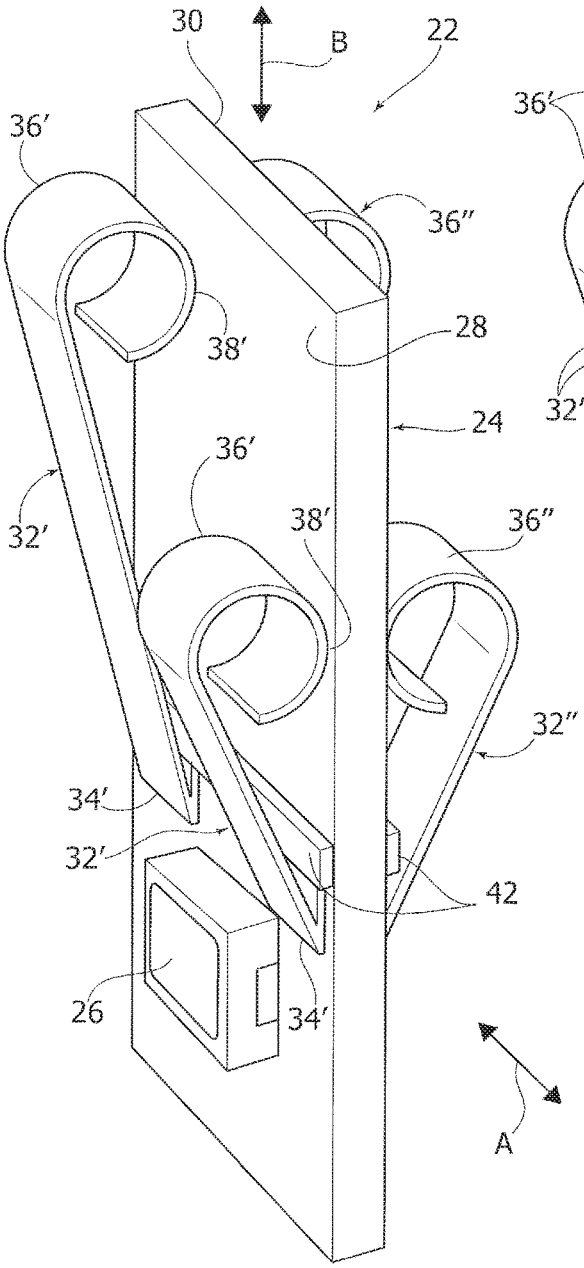
FIGS. 3, 4 and 5 are perspective views of embodiments of lighting modules.
Figure 4:
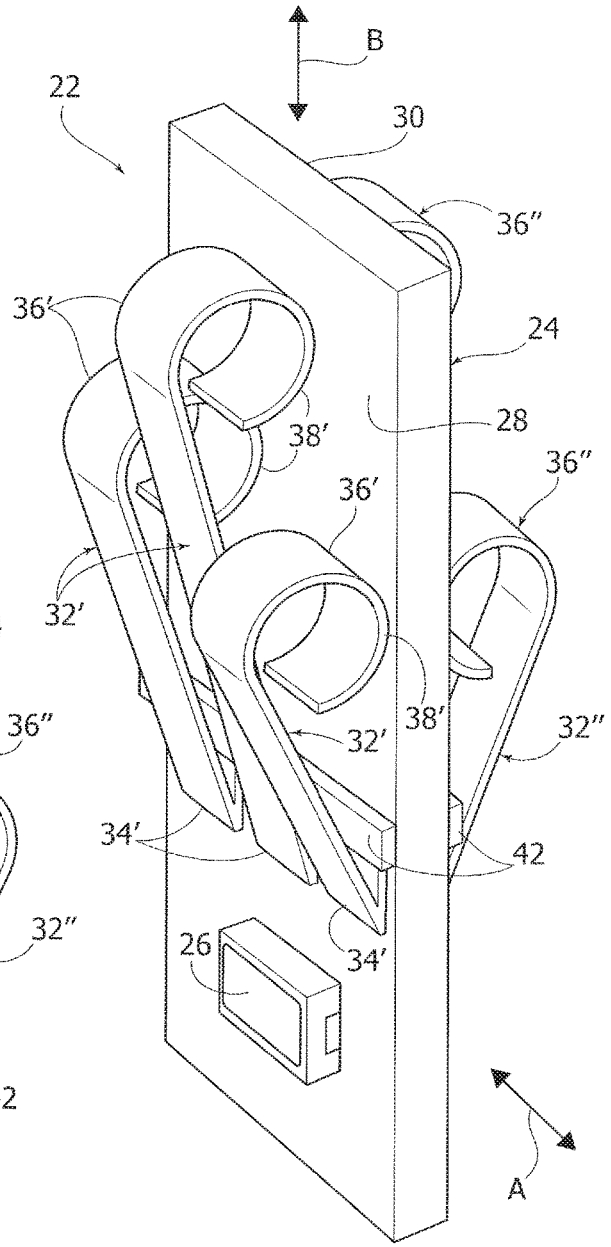
Figure 5:
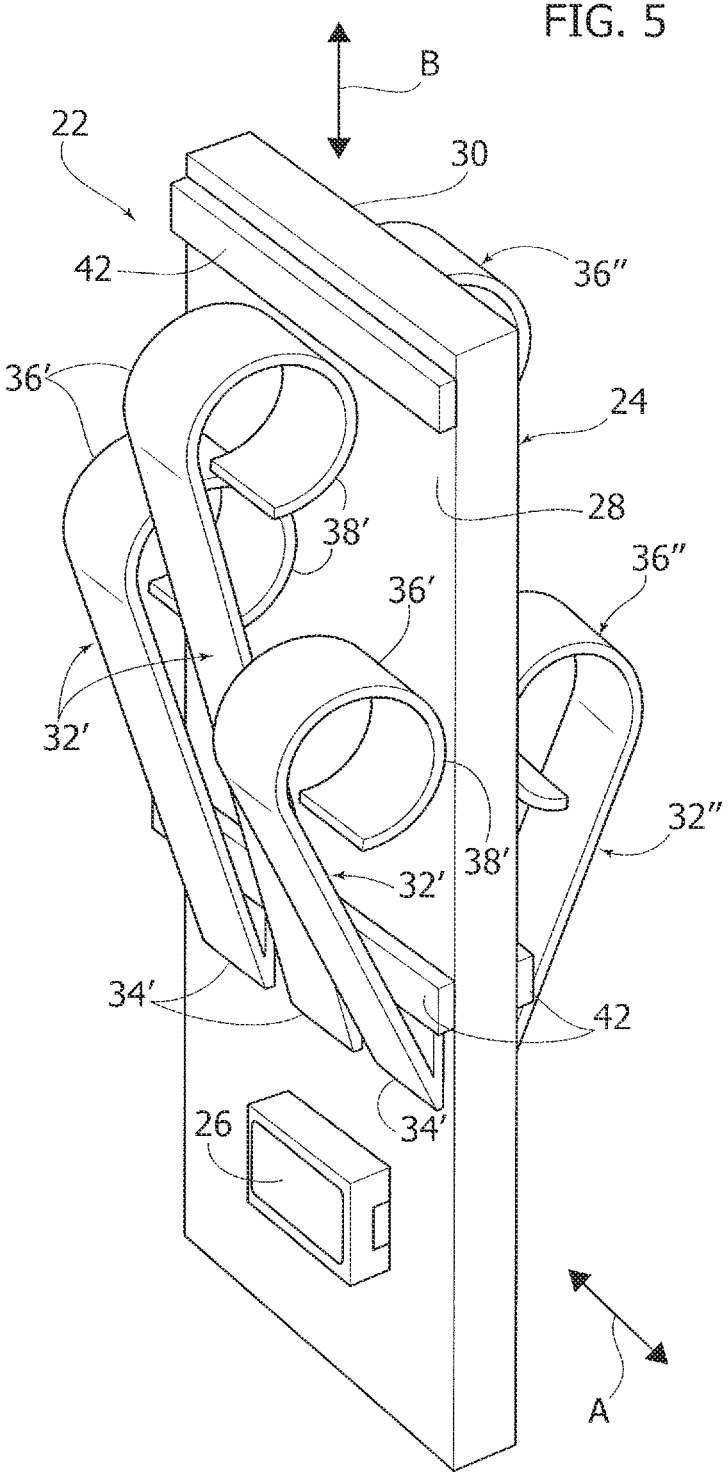

FIGS. 3 to 5 show different embodiments of a lighting module 22. In one or more embodiments, the lighting module 22 may include a base 24, which may carry at least one electrically powered light radiation source 26, e.g. a solid-state light radiation source such as a LED source. In one or more embodiments, the base 24 may have the shape of a plate, having a first face 28 and a second face 30 parallel to each other. In one or more embodiments, the light radiation source 26 may be fixed to one of the faces 28, 30 of the base 24. The arrangement of the light radiation source 26 on one of the faces 28, 30 of base 24 may implement a side light emission. Different light emissions may be obtained by using side emitting diodes, optical elements or an arrangement wherein, for example, the light source 26 is carried by an additional printed circuit, which is orthogonally connected to base 24.

In one or more embodiments, the lighting module 22 may include a plurality of lamina electrical contacts 32', 32", which are electrically connected to the light radiation source 26. In one or more embodiments, the lighting module 22 may include first lamina electrical contacts 32' arranged on the first face 28 of base 24, and second lamina electrical contacts 32" arranged on the second face 30 of base 24, in order to enable installing the lighting module 22 with opposite orientations of the light radiation source 26.

In one or more embodiments, each lamina spring contact 32', 32" has a proximal end 34', 24" fixed to the base 24, and a distal end 36', 26" having a contact area 38', 28" which is elastically pressed against the respective face 28, 30 of base 24.

In one or more embodiments, the distal ends 36 of the lamina spring contacts 32 may be curl-shaped.

In one or more embodiments, the lighting module 22 may include two or more lamina electrical contacts 32', 32" on one and the same face 28, 30 of base 22. For example, in an embodiment (FIG. 3), the lighting module may have two contacts 32', 32" for supplying monochrome and white light radiation sources 26. In one or more embodiments (FIGS. 4 and 5) the lighting module 22 may have three lamina electrical contacts 32', 32", for supplying tuneable white light radiation sources 26. In one or more embodiments (not shown) the lighting module 22 may have four lamina electrical contacts 32', 32", for supplying an RGB light radiation source.

In one or more embodiments, the lamina spring contacts 32', 32" may be parallel and spaced apart along a longitudinal direction A.

In one or more embodiments the contact areas 38', 38" of the lamina spring contacts 32', 32" may be mutually offset in a transverse direction B, orthogonal to said longitudinal direction A.

Figure 6:
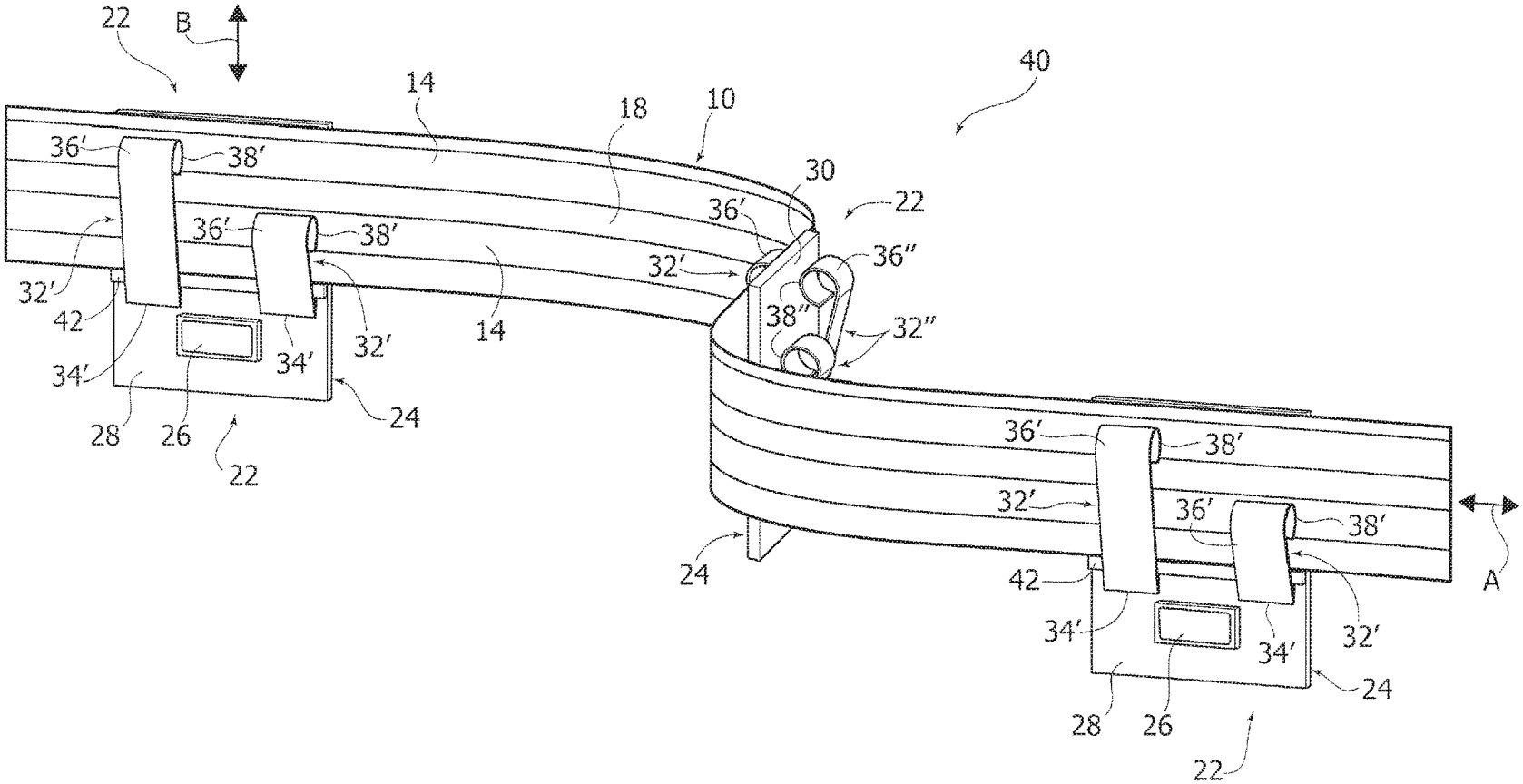
FIG. 6 is a perspective view of an embodiment of a lighting system.

In FIG. 6, reference 40 denotes a lighting system which may include a conductive support 10 and a plurality of lighting modules 22.

In one or more embodiments, the conductive support 10 has a number of conductive tracks 14 equal to the number of the electrical contacts 32', 32" of the lighting modules 32.

In one or more embodiments, the lighting modules 22 may be applied to the conductive support 10 by a movement in the transverse direction B, by inserting the conductive support 10 between a face 28, 30 of base 24 and the distal ends 36', 36" of the electrical contacts 32', 32". The contact areas 38', 28" of the lamina electrical contacts 32', 32" may be pressed against respective conductive tracks 14.

In one or more embodiments, the lighting modules 22 may include at least one positioning rib 42, protruding from face 28, 30 of base 24 and elongate in the longitudinal direction A, for supporting at least one corresponding edge of conductive support 10, so as to favour the correct alignment between the supply module 22 and the conductive support 10.

In one or more embodiments (FIG. 5), the lighting module 22 may include two positioning ribs 42 spaced apart in the transverse direction B by a distance corresponding to the width of the conductive support 10, so as to favour the alignment of the lighting module 22 with respect to both opposite edges of the conductive support 10.

The spring force that elastically presses the contact areas 38', 38" of the lamina electrical contacts 32', 32" against base 24 may retain the conductive support 10 pressed between the distal ends 36', 36" of the lamina electrical contacts 32 and the base 24. Therefore, the lighting modules 22 may be connected to the conductive support 10 only thanks the elastic pressure of the lamina electrical contacts 32', 32". Therefore, the lamina electrical contacts 32', 32" may establish both the electrical and the mechanical connection between the lighting module 22 and the conductive support 10. This connection may enable a movement of the individual lighting modules 22 with respect to the conductive support 10 in the longitudinal direction A, by sliding the contact areas 38', 38" of the lamina electrical contacts 32', 32" against the respective conductive tracks 14.

The end user is also offered the possibility of removing and repositioning individual lighting modules 22. This solution may therefore be employed when the lighting modules 22 must be applied onto the conductive module with a non-constant pitch. When lamina electrical contacts 32', 32" are present on both faces 28, 30 of the lighting module 22, it is also possible to vary the orientation of the lighting modules 22 with respect to the conductive support 10, e.g. in order to change the emission direction of the light radiation.

Figure 7:
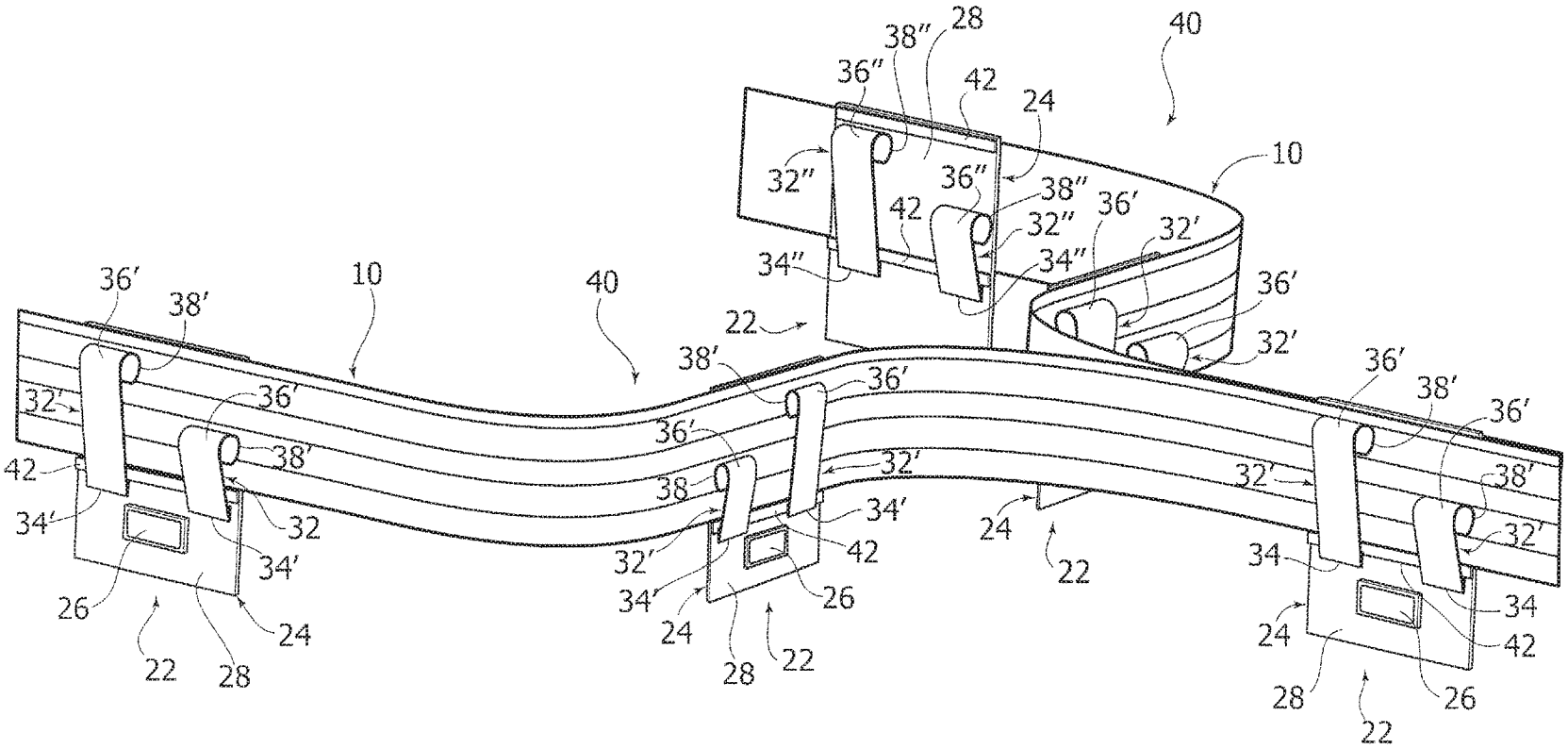
FIG. 7 is a perspective view showing an embodiment of a lighting system with a branch.

In one or more embodiments, the lighting system 40 may be used in order to form lighting paths with crossings and branches. For example, FIG. 7 shows the instance wherein two lighting systems 40, each including a conductive support 10 and a plurality of lighting modules 22, are arranged with a general Y-shaped configuration.

Figure 8:
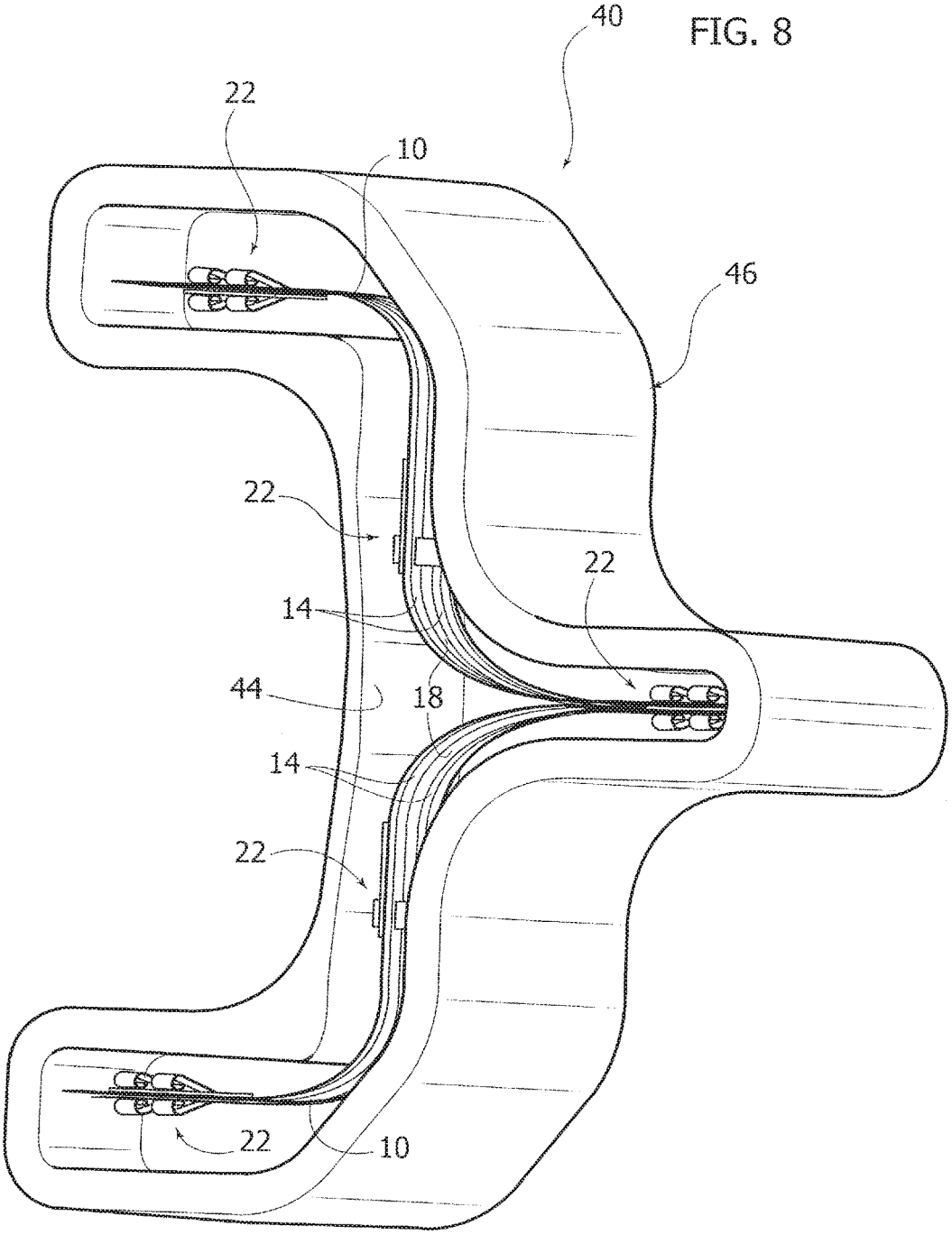
FIG. 8 is a perspective view showing an embodiment of a lighting system including a casing.

With reference to FIG. 8, in one or more embodiments the lighting system 40 may include a casing having a cavity 44, which may host one or more conductive supports 10 and a plurality of lighting modules 22 connected to the conductive supports 10. In one or more embodiments, cavity 44 may be provided with seats which are adapted to receive respective lighting modules 22. In one or more embodiments, the positioning of conductive support 10 in the cavity 44 of casing 46 may be achieved with glue or adhesive tapes.

In the case of outdoor lighting systems or in the case of lighting systems for heavy environmental conditions (vibrations, moisture, corrosive agents etc.), the cavity 44 of casing 46 may be filled with a solid or gelly potting material, in order to ensure the resistance to shocks and vibrations, and for the protection from moisture and corrosive agents.

One or more embodiments may therefore concern a lighting module which may include:

a base (e.g. 24), at least one electrically powered light radiation source (e.g. 26) carried by said base (e.g. 24), a plurality of lamina electrical contacts (e.g. 32', 32") which may be connected to said light radiation source, and which may have respective proximal ends (e.g. 34', 34") fixed to said base (e.g. 24) and respective distal ends (e.g. 36', 36") which may be elastically pressed against one face (e.g. 28, 30) of said base (24), wherein the distal ends (e.g. 36', 36") of said lamina electrical contacts (e.g. 32', 32") may have respective mutually offset contact areas (e.g. 38', 38").

In one or more embodiments, said lamina electrical contacts (e.g. 32', 32") may be parallel and spaced apart along a longitudinal direction (e.g. A).

In one or more embodiments, said contact areas (e.g. 38', 38") are mutually offset in a transverse direction (e.g. B) orthogonal to said longitudinal direction (e.g. A).

In one or more embodiments, the lighting module may include a plurality of first electrical contacts (e.g. 32') which may act on a first face (28) of said base (e.g. 24) and a plurality of second electrical contacts (e.g. 32") which may act on a second face (e.g. 30) of said base (e.g. 24).

In one or more embodiments, the distal ends (e.g. 36', 36") of said lamina electrical contacts (32', 32") may have a curl shape.

One or more embodiments may concern a lighting system which may include:

a conductive support (e.g. 10) which may include a tape (e.g. 12) of insulating material, which may have a first face (e.g. 18) and a second face (e.g. 20), and a plurality of conductive tracks (e.g. 14) applied on said first face (e.g. 18), which may extend along a longitudinal direction (e.g. A) and may be spaced apart along a transverse direction (e.g. B), and at least one lighting module (e.g. 22) connected to said conductive support (10), wherein one face (e.g. 28, 30) of the base (24) of the lighting module (e.g. 22) may rest against the second face (e.g. 20) of said tape (e.g. 12), and wherein the contact areas (e.g. 38', 38") of said lamina electrical contacts (32', 32") may be elastically pressed against respective conductive tracks (e.g. 14) of said conductive support (e.g. 10).

In one or more embodiments, one face (e.g. 28, 30) of said base (e.g. 24) may have at least one positioning rib (e.g. 42) resting against a respective edge of said tape (e.g. 12).

In one or more embodiments, the face (e.g. 28, 30) of said base (e.g. 24) may include two positioning ribs (e.g. 42) parallel to one another, which may rest against opposite edges of said tape (e.g. 12).

In one or more embodiments, the lighting system may include a casing (e.g. 46) which may have a cavity (e.g. 44) in which there may be housed the conductive support (e.g. 10) and at least one lighting module (e.g. 22) connected to the conductive support (e.g. 10)

In one or more embodiments, said cavity (e.g. 44) may be filled with a potting material.

Without prejudice to the basic principles, the implementation details and the embodiments may vary, even appreciably, with respect to what has been described herein by way of non-limiting example only, without departing from the extent of protection.

Said extent of protection is defined by the annexed claims.

LIST OF REFERENCE SIGNS

Conductive support 10
Tape 12
Conductive tracks 14
First face 18
Second face 20
Lighting module 22
Base 24
Light radiation source 26
First face 28
Second face 30
First lamina electrical contacts 32'
Second lamina electrical contacts 32"
Proximal ends 34', 34"
Distal ends 36', 36"
Contact area 38', 38"
Lighting system 40
Positioning rib 42
Cavity 44
Casing 46

The invention claimed is:

1. A lighting module comprising:

a base, at least one electrically powered light radiation source carried by said base, a plurality of lamina electrical contacts connected to said source of light radiation, wherein each of the plurality of lamina electrical contacts has a respective proximal end fixed to said base and a respective distal end including a contact area, wherein each contact area of the respective distal ends is elastically pressed against one face of said base, and wherein the contact areas are offset from each other.

2. The lighting module according to claim 1, wherein said lamina electrical contacts are parallel to each other along a traverse direction and are spaced apart along a longitudinal direction orthogonal to the traverse direction.

3. The lighting module according to claim 2, wherein said contact areas are offset from each other in the transverse direction orthogonal.

4. The lighting module according to claim 1, comprising a plurality of first electrical contacts acting on a first face of said base and a plurality of second electrical contacts acting on a second face of said base.

5. The lighting module according to claim 1, wherein the distal ends of said lamina electrical contacts have a curl shape.

6. A lighting system comprising:

a conductive support including a tape of insulating material having a first face and a second face, and a plurality of conductive tracks applied on said first face, extending along a longitudinal direction and spaced apart along a transverse direction, and at least one lighting module, the at least one lighting module comprising:

a base, at least one electrically powered light radiation source carried by said base, a plurality of lamina electrical contacts connected to said source of light radiation, wherein each of the plurality of lamina electrical contacts has a respective proximal end fixed to said base and a respective distal end including a contact area, wherein each contact area of the respective distal ends are elastically pressed against a first face of said base, and wherein the contact areas are offset from each other, wherein the first face of said base of the at least one lighting module rests against said second face of said tape and wherein said contact areas of said lamina electrical contacts are directly pressed elastically against respective conductive tracks of said conductive support.

7. The lighting system according to claim 6, wherein said face of said base has at least one positioning rib which rests against a respective edge of said tape.

8. The lighting system according to claim 7, wherein said face of said base comprises two positioning ribs parallel to one another that rest against opposite edges of said tape.

9. The lighting system according to claim 6, comprising a casing having a cavity in which there is housed said conductive support and said at least one lighting module connected to said conductive support.

10. The lighting system according to claim 9, wherein said cavity is filled with a potting material.

* * * * *